United States Patent [19]

Anderson

[11] 4,301,637

[45] Nov. 24, 1981

[54] QUICK STACK BUILDING BLOCK

[76] Inventor: Thomas W. Anderson, 1209 Boxwood La., Apex, N.C. 27502

[21] Appl. No.: 75,963

[22] Filed: Sep. 17, 1979

[51] Int. Cl.[3] ..... E04C 2/04

[52] U.S. Cl. ..... 52/594; 52/603

[58] Field of Search ..... 52/585, 586, 594, 603, 52/595, 593

[56] References Cited

U.S. PATENT DOCUMENTS 3,936,987 2/1976 Calvin ..... 52/309

FOREIGN PATENT DOCUMENTS 1126050 11/1956 France ..... 52/594
528713 6/1955 Italy ..... 52/594
791 of 1860 United Kingdom ..... 52/585
527565 7/1921 United Kingdom ..... 52/585
702641 1/1954 United Kingdom ..... 52/594

*Primary Examiner*—Price C. Faw, Jr.
*Assistant Examiner*—Henry E. Raduazo

[57] ABSTRACT

A basic building block with rectangular projections d and a (FIG. 1) rising from the top center portion of the plane of bearing surface 42 (FIG. 4) being approximately one-eighth of the total height, labeled "d" and "H", respectively, in FIG. 3, the dimension "j" (FIG. 4) of the projection being somewhat less than the dimension "k" of the end of the block. The aforementioned-projection is symmetrical with the intersection of the longitudinal center line "X" and the traverse center line "Y" in FIG. 4.

1 Claim, 4 Drawing Figures

I $a = W/4$
II $a = 2B + C$
III $L = 2W$
IV $W = H$
V $d = H/8$

I $a = W/4$
II $a = 2B \div C$
III $L = 2W$
IV $W = H$
V $d = H/8$

QUICK STACK BUILDING BLOCK

DESCRIPTION

TECHNICAL FIELD

The fundamental purpose of this invention is to provide a design by which masonry building blocks can be made that can be laid to construct a wall, foundation or building by a person or persons with little or no experience in the building trade. Furthermore, these persons' endeavors will produce a wall, foundation, or building that will have increased strength and beauty over ones built with conventional building blocks. The increased strength will come from the interlocking feature of this invention. The additional beauty will result from a straighter wall with more uniform joints, the net result all of which is reduced cost.

BACKGROUND ART

The art of making and laying bricks or blocks for the construction of some architectural form had its beginnings somewhere back in the dim edges of history. Kiln burnt bricks made by the Babylonians are still in existence, now 6,000 years old.

The Egyptians made bricks that were dried only by the sun. They later learned that mixing straw with the mud would add strength.

Another method used in the southwest part of this country was to cut the desired size and shape block right out of the bed where the clay was found.

The Greeks built with quarried stone and did not use mortar. Their blocks were held together by interlocking joints, arches, etc.

Hydraulic mortar was re-invented after being lost during the Dark Ages. It could withstand the ravages of water to a high degree and was used to construct lighthouses in England.

The next improvement was the invention of portland cement. It was invented by Joseph Aspdin of Leeds, England. The cement looked like the stone quarried on the Isle of Portland, thus the name.

The next improvement came in relatively recent times. It was a larger element that would save material. This was accomplished by coring out as in concrete or cinder block, leaving hollows as in clay tile, the tile being extruded and the blocks being molded.

It is therefore evident that in an industry that is so primary to the needs of the people, a new way of making and/or laying the elements of a wall, foundation or building is very much needed.

DISCLOSURE OF INVENTION

Referring to FIG. 1, beginning at the quoin Q, a door or any other desired starting point, conventional smooth-end blocks S1 and S2 are used as would be the case with any masonry wall built to standards of good workmanship.

The first course is laid in place with mortar in a predetermined straight line on a foundation that has been prepared straight and level and of sufficient strength. Along with the instruction of the preceding sentence, the following also applies: Block 1 is placed in line with and correctly spaced from block S2. Block 2 next is set in approximately the correct position, the exact position being located by using 3 as a spacer and alignment tool. Block 2 is urged to the left until its center projection comes in contact with the right end of block 3, block 3 at the same time coming in contact with the center projection of block 1. This same routine holds true for blocks 5 and 6 and all other blocks in the first two courses. Two courses are effectively being laid at the same time because when a block is used as a spacer each time, such as blocks 3 and 6, it can be left in place. Block 4 can be retro-fitted using block 7 as a spacer. Then S1 is aligned to the quoin Q conventionally. The additional courses can now be stacked dry without any close attention to their alignment and position.

The mortar can be applied immediately after the stacking or at some later time by additional workers or by the same workman who did the stacking.

Figure 1:
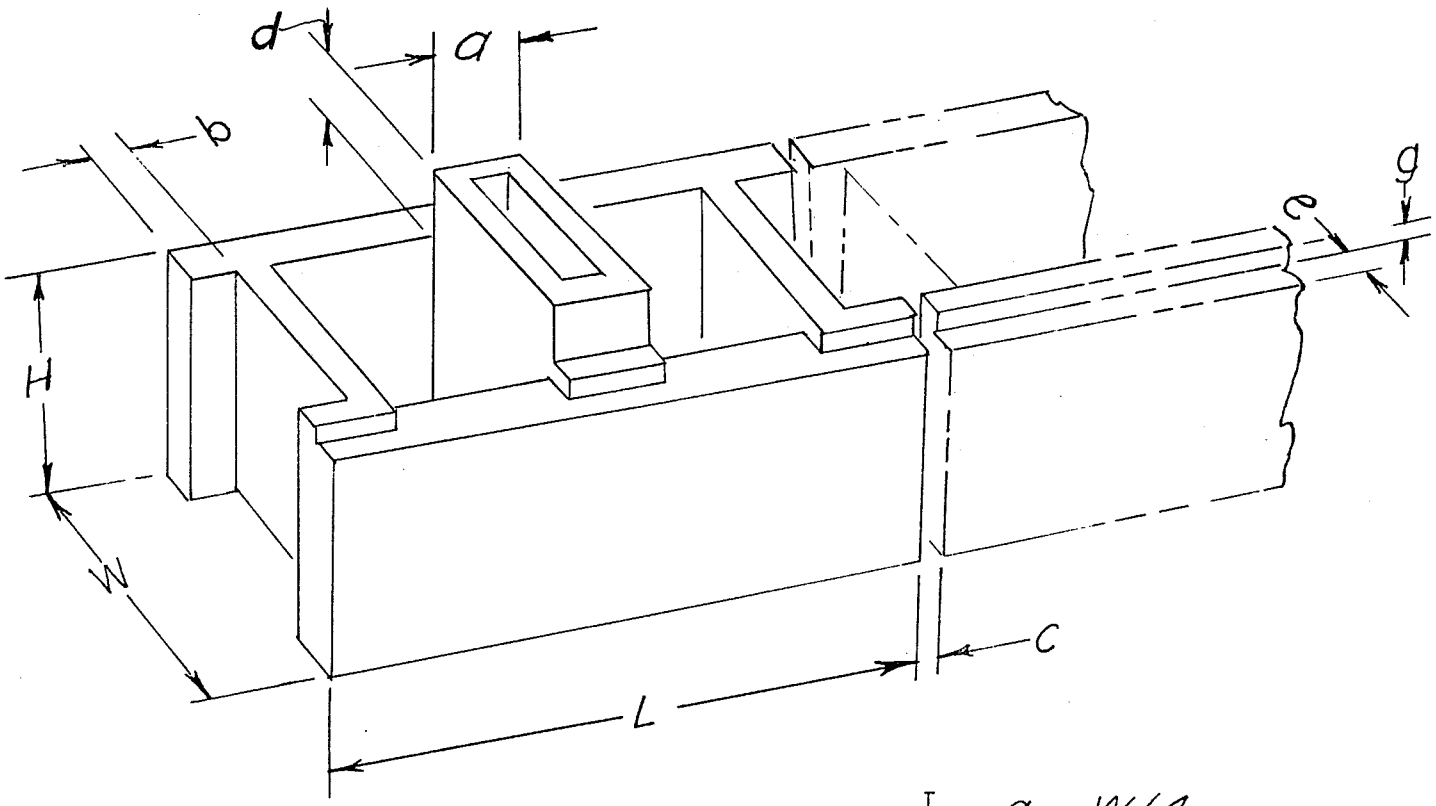
FIG. 1 shows the cardinal dimensions H, L, W, a, b, c, and d. The controlling relations between these dimensions are given in the equations I, II, III, IV, and V. This is one set of equations that produces the necessary proportions of Quick Stack Blocks but is not necessarily the only set that will.
Figure 2:
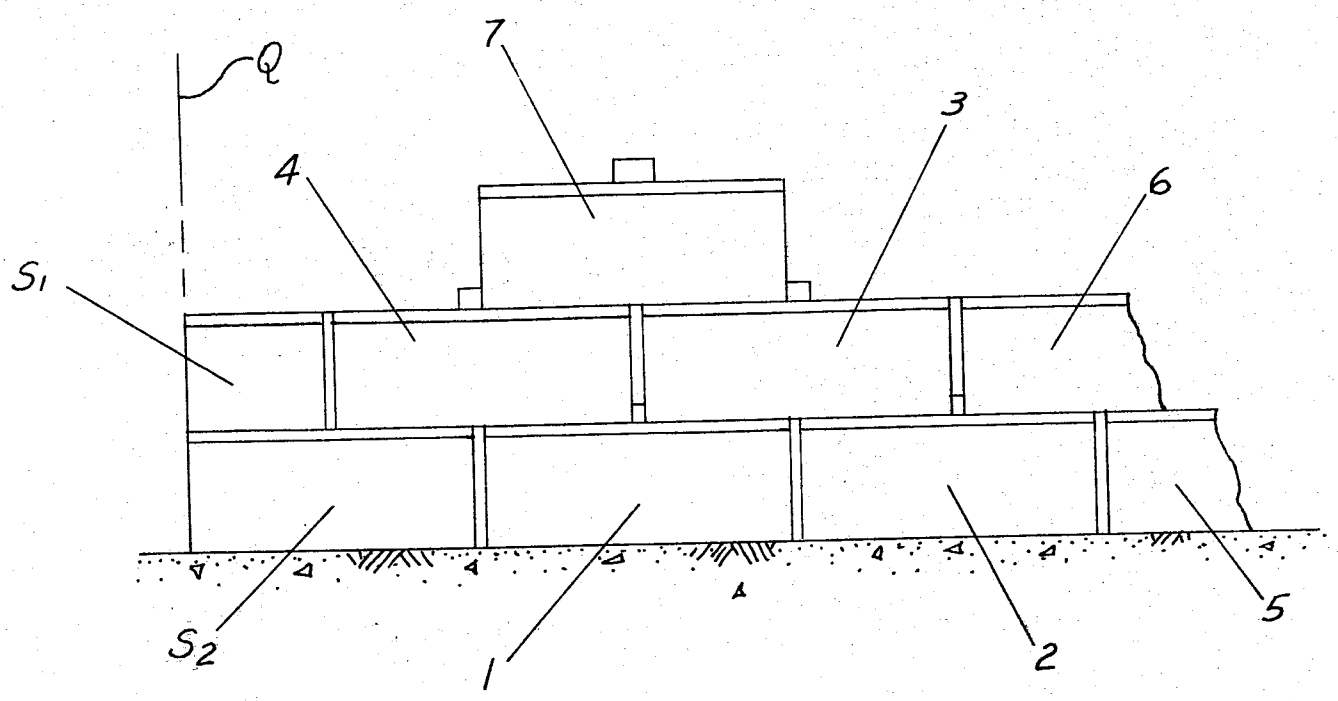
FIG. 2 depicts the procedure in laying Quick Stack Blocks.
Figure 3:
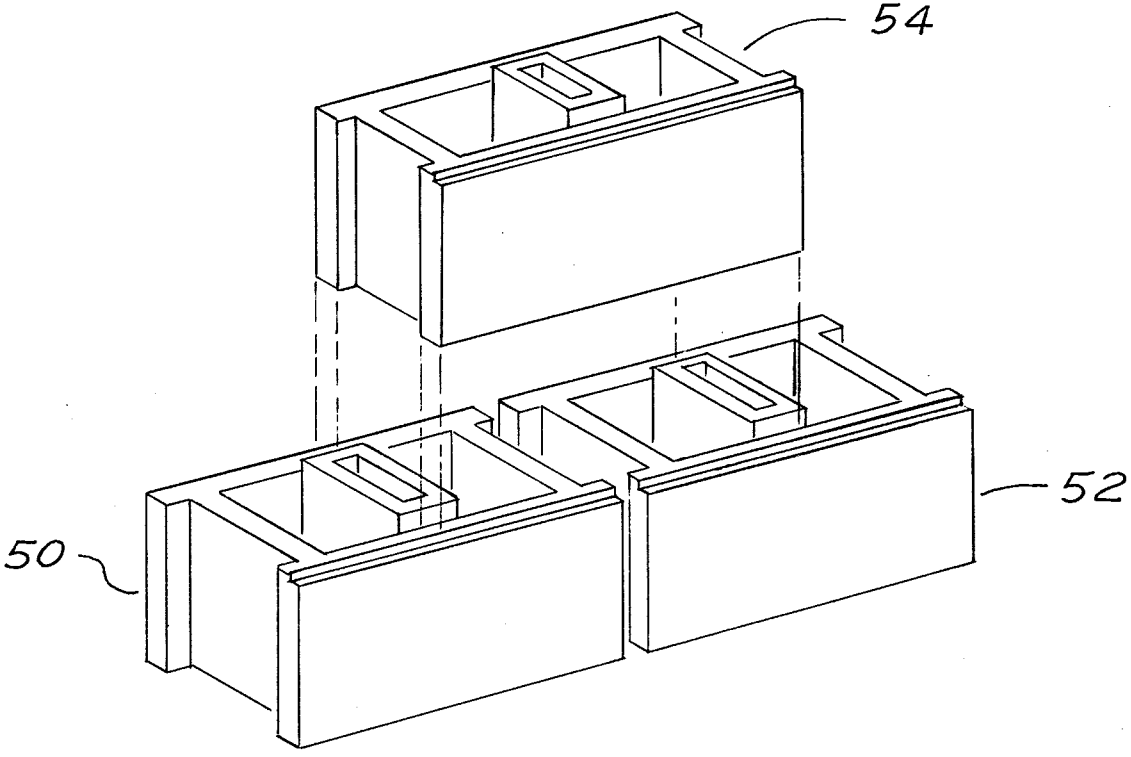
FIG. 3 is a perspective showing how each block is lowered into place in each successive higher course, more specifically showing how the center projection in a lower course will engage in the U-shaped end of the next higher course, and how the "new" block each time will be caused to be located into perfect position and alignment without any influence from the person or machine that is handling the block.

In detail, surface 26 of block 50 will contact surface 18 of block 54; surface 16 with 22; and surface 20 with 24. Surface 28 of block 52 will contact surface 12 of block 54. Surface 22 of block 54 will contact surface 22 of block 52, and likewise, surface 14 of block 54 will contact surface 24 of block 52.

Figure 4:
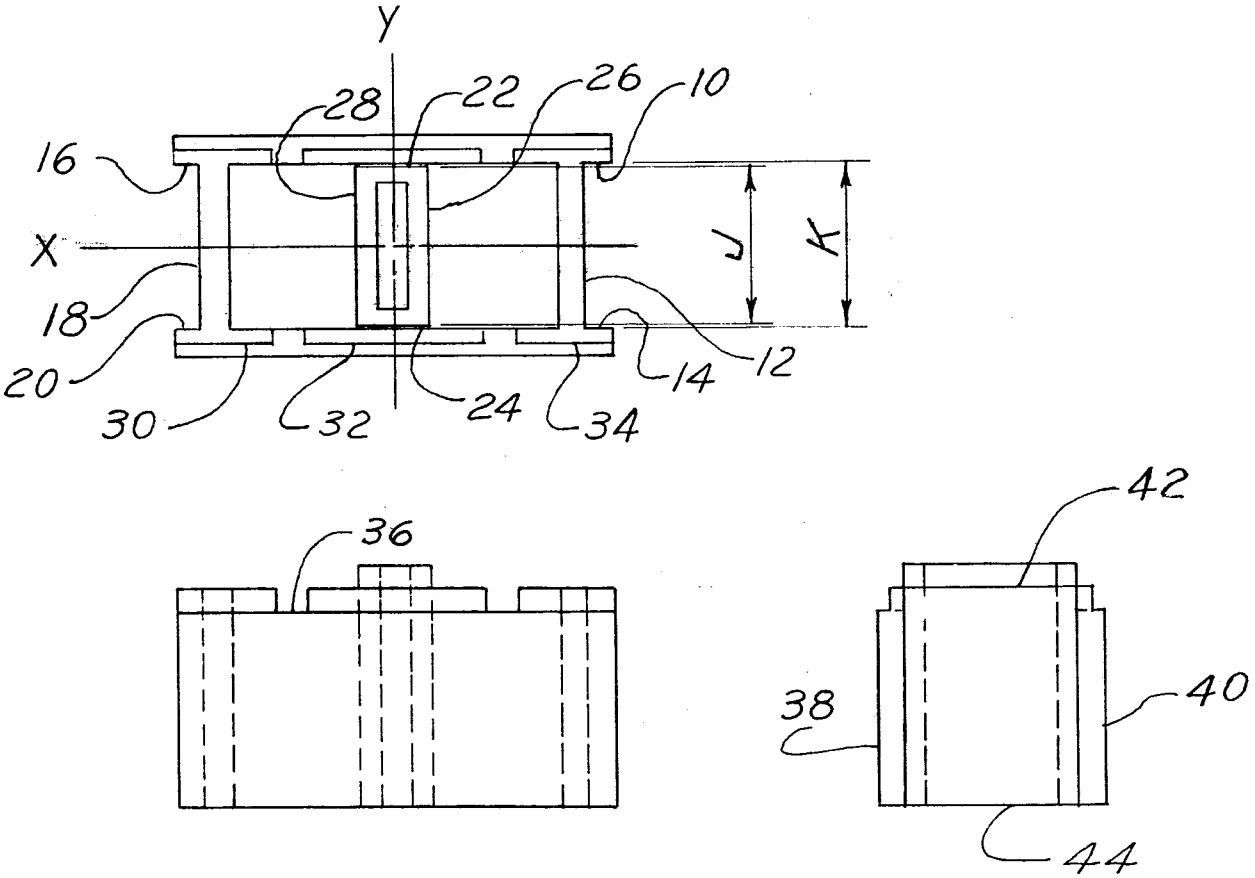
FIG. 4 shows the three orthagraphic views, referring more specifically to surfaces 42 and 44 contacting each other as they are stacked or laid in a wall, foundation and/or building which have already been defined. See also FIG. 3.

Referring again to FIG. 4, the tolerance on the dimension j will have to be minus only, and the tolerance on the dimension k will have to be plus only if the nominal dimensions are the same, to insure engaging of these parts of adjoining blocks.

Referring to FIG. 1, it will be noted that the net difference between the projecting sides a and b of a block automatically create the vertical joint c between any adjacent blocks.

The configuration of the center projection of a and d can be essentially rectangular with small radii on the corners or it may be elliptical, semi-elliptical, or some combination of the above; but whatever it may be, the mating parts, surfaces 16, 18, 20 or surfaces 10, 12, 14 as the case may be, must be the same.

DESCRIPTION OF THE INVENTION

This invention embodies a simple change to the top surface of the basic building block used in the erection of walls, foundations and/or buildings which brings about distinct advantages over the age-old practice of forming and stacking blocks.

The block consists mainly of projections 24, 26, 27, and 28 (FIG. 4) in the top center portion above the plane of bearing surface 42. These projections are so proportioned and related to the open "U" shape of ends

10, 12, 14, 16, 18, and 20 of the block that when stacked on top of each other as in a wall, foundation and/or building, an interlock is formed from the course below to the course above. At the same time, a uniform vertical joint is created between adjacent blocks C (FIG. 1). Automatic alignment of the faces of the blocks is also brought about 38 and 40.

The other feature of the invention besides the aforementioned projection is a groove 30, 32, 34, or 36 running longitudinally along the top edge of the outside face or faces. This groove is so proportioned and located that when blocks made as described above are laid or stacked into a wall, foundation and/or building, continuous horizontal joint is formed into which reinforcing steel and/or mortar may be placed after several courses of blocks are stacked or laid. This means that more than one person at a time can be set to the task.

The projection described above does not necessarily have to be an integral part of the block. It may be a tool that can be moved each time after the alignment is created, or it may be a loose insert of masonry or some other material that will become a permanent part of the wall, foundation and/or building.

I claim:

1. A generally rectangularly shaped building block comprising:

a pair of vertical, opposite, side walls;

a pair of vertical, opposite, end walls traverse of said side walls;

a pair of opposite upper and lower longitudinally extending faces formed by the top and bottom surfaces of said side and end walls;

a generally rectangular wall structure extending centrally across said block between said side walls, and said central wall structure being spaced from said end walls and extending above said upper face of the block and having therein a generally rectangular cavity extending vertically completely through said wall structure; and each end wall including extensions of said side walls for a distance conforming to one-half the longitudinal thickness of said rectangular wall structure, whereby, with multiple courses of laid block, and with a half block stagger of blocks, as between courses, blocks of one course and blocks between courses are interlocked by an upwardly extending portion of said wall structure into indentations between blocks of an upper course of said blocks, and there exists three full cavities: said cavity formed by said wall structure, and two cavities between it and said side walls and said end walls, wherein after blocks are laid, mortar can be introduced into said three cavities in the construction of a block wall.

* * * * *